United States Patent [19]

Werner

[11] 3,966,126

[45] June 29, 1976

[54] CLASSIFYING HAMMERMILL SYSTEM AND METHOD OF OPERATION

[75] Inventor: Edward E. Werner, Oshkosh, Wis.

[73] Assignee: Kimberly-Clark Corporation, Neenah, Wis.

[22] Filed: Feb. 10, 1975

[21] Appl. No.: 548,593

[52] U.S. Cl. ..... 241/18; 241/24; 241/27; 241/54; 241/154; 241/188 R

[51] Int. Cl.[2] ..... B02C 23/30

[58] Field of Search ..... 241/18, 19, 24, 27, 241/29, 54, 58, 70, 71, 72, 154, 185 R, 186 R, 188 R, 299

[56] References Cited

UNITED STATES PATENTS

| | | | |
|---|---|---|---|
| 189,959 | 4/1877 | Ryerson | 241/154 X |
| 254,403 | 2/1882 | Storer | 241/154 X |
| 1,832,468 | 11/1931 | McMillan et al. | 241/188 R |
| 2,609,995 | 9/1952 | Klagsbrunn | 241/188 R |
| 3,547,356 | 12/1970 | Asplund | 241/54 X |

*Primary Examiner*—Granville Y. Custer, Jr.
*Attorney, Agent, or Firm*—Daniel J. Hanlon, Jr.; William D. Herrick; Raymond J. Miller

[57] ABSTRACT

An apparatus and method for processing fibrous material into fluff and substantially individual fibers. The apparatus includes a hammermill having an impermeable wall of grid-like configuration against which fibrous material to be fiberized is thrown by impact element rotation. The fibrous material is conveyed through the mill in an air stream which defines a general path for the fibrous material under the influence of impact element rotation. The grid-like wall serves to slow the particles of fiber rebounding from the wall so that the particles are subjected to repeated impacts by the impact elements of the mills. Rings divide the interior of the hammermill to control the fiber flow in the air stream to the outlet. A pair of hammermills in sequence permits pulps which are difficult to defiberize to be readily reduced to fluff.

4 Claims, 19 Drawing Figures

CLASSIFYING HAMMERMILL SYSTEM AND METHOD OF OPERATION

BACKGROUND OF THE INVENTION

This invention relates to an improved apparatus and method for processing fibrous material into substantially individual fibers in the form of a fluff, the fibers being suitably collected as a thin batt, thin mat or the like.

Fiber fluff from cellulose wood pulp or cotton is a well-known material having particular utility in absorbent products such as sanitary napkins, diapers and the like. The process and apparatus to be described herein are useful to fluff a variety of materials. It is particularly useful, however, in the defiberizing and fluffing of the materials which are more difficult to fluff. Such includes wood pulp which resists fluffing to a greater or lesser degree depending upon its history. For example, cellulose pulp is usually supplied by pulp mills as rolls or as short sheets. Commonly, roll pulp in the course of manufacture is less pressed than sheet pulp and somewhat more easily defiberized to an individual fiber condition with minimum cutting of the fibers.

DESCRIPTION OF THE INVENTION

In the practice of this invention the feed to the apparatus may be in the form of long strips of roll pulp, or as short sheets, usually not over 3 to 4 feet in length, or as short strips or small pieces. For the handling of long strips and short sheets in accordance with the present invention, it is desirable to subject these to an initial defiberizing prior to feeding the material to the principal defibrator and fiber separator. In such instances the initial defibrator may be a conventional hammermill available commercially or may have the new structural arrangement of the apparatus of my present invention described herein.

While fluffing equipment and procedures have been practiced by manufacturers of absorbent materials for many years, the use of such absorbents has grown considerably and efforts have been made to provide more economical procedures as well as processes which tend to reduce power requirements for the fiber separation and subsequent fiber collection.

In my present invention the fibrous material is introduced into equipment in which the fibrous material in a current of air is impacted to break it into individual fibers or very small fluffy clusters of fibers typically known as fluff. The impacting is effected with impact elements such as the conventional hammers of a hammermill. The rapid rotation of the hammers causes the impacted fibrous material to be thrown outwardly from the center of rotation and simultaneously the air movement is caused, also by the hammer action, to assume a helical path in which the fibrous material moves. Importantly, the fibrous material movement is slowed by contact with the apparatus wall and a speed differential is created between the movement of the fibrous material and the hammers. The fibrous material then, as it is broken into smaller particles and is slower moving, is subject to repeated impacts by the hammers. The slowed movement of the fibrous material is occasioned by contact with the wall of the apparatus towards which the hammers move in their rotation, and the wall is deliberately made in the form of a grid to cause this slowing action. The term "grid" will be understood to mean a surface other than that which is continuous and smooth, that is, the wall has a surface which tends to receive the fibers therein but is aerodynamically designed to provide fiber release; thus, the wall may have discontinuities such as is occasioned by the presence of risers, a screen or pockets. It is understood, however, that for the purpose of my invention the wall, even though including a screen, is itself overall impervious to the passage of fibers.

In the practice of the invention the apparatus has means for minimizing the energy expended in fiber separation. This includes an arrangement for promptly removing individual or fluffed fibers from the zone of the impacting elements, while retaining the particles which are insufficiently defiberized. Specifically, in the helical air current, freed fibers which are light or low in density will, by virtue of the air movement about a hammer, tend to be moved out of the path of the hammers so that such are not subjected to unnecessary repeated impact action.

Further, the equipment includes axially disposed ring means which the fibers in the helical air stream traverse in their movement to the outlet of the equipment from the fibrous material inlet. These rings are conveniently termed classifier rings and may be one or more in number. The effect of the rings is to retain more dense fibrous material, that is, material not well defiberized, from moving to the outlet. For this purpose the rings may all have the same internal diameter but, preferably, the internal diameter decreases with the proximity of the ring to the outlet.

Quite surprisingly, it has been found that the classifier rings function most effectively when the ring annulus is perforated, that is, has apertures through which the fibrous material may pass. Additionally, I have found that operation is improved when the apertures have different diameters.

The rings are not necessary to the fiberizing action but do aid fiber separation by a classification action and provide for an improved equipment capacity at a given volume of air flow. The presence of apertures in the annulus of a ring further enhances the equipment capacity and the classification action as the well defiberized material may escape through the apertures rather than over the annulus interior.

The specific dimensions of the equipment, for example, the length of a compartment defined by rings or the open area of an annulus, is critical ciritical in the sense that specific limits are required for operation but is important in attaining optimum operation and will be discussed hereinafter.

It is, accordingly, a primary object of this invention to provide a new, novel and beneficial equipment arrangement for defiberizing of fibrous material such as wood pulp.

It is an important object of the invention to provide a novel process for the defiberizing of fibrous material and which tends to minimize power requirements in effecting defiberizing.

The invention will be more fully understood with respect to the following detailed description and accompanying drawings wherein:

FIG. 1 is a perspective view with parts broken away and in schematic form of fiberizing equipment in accordance with the invention;

FIG. 1*a* is a view of apparatus similar to that of FIG. 1 but illustrating a different mode of pulp feed;

Figure 2:
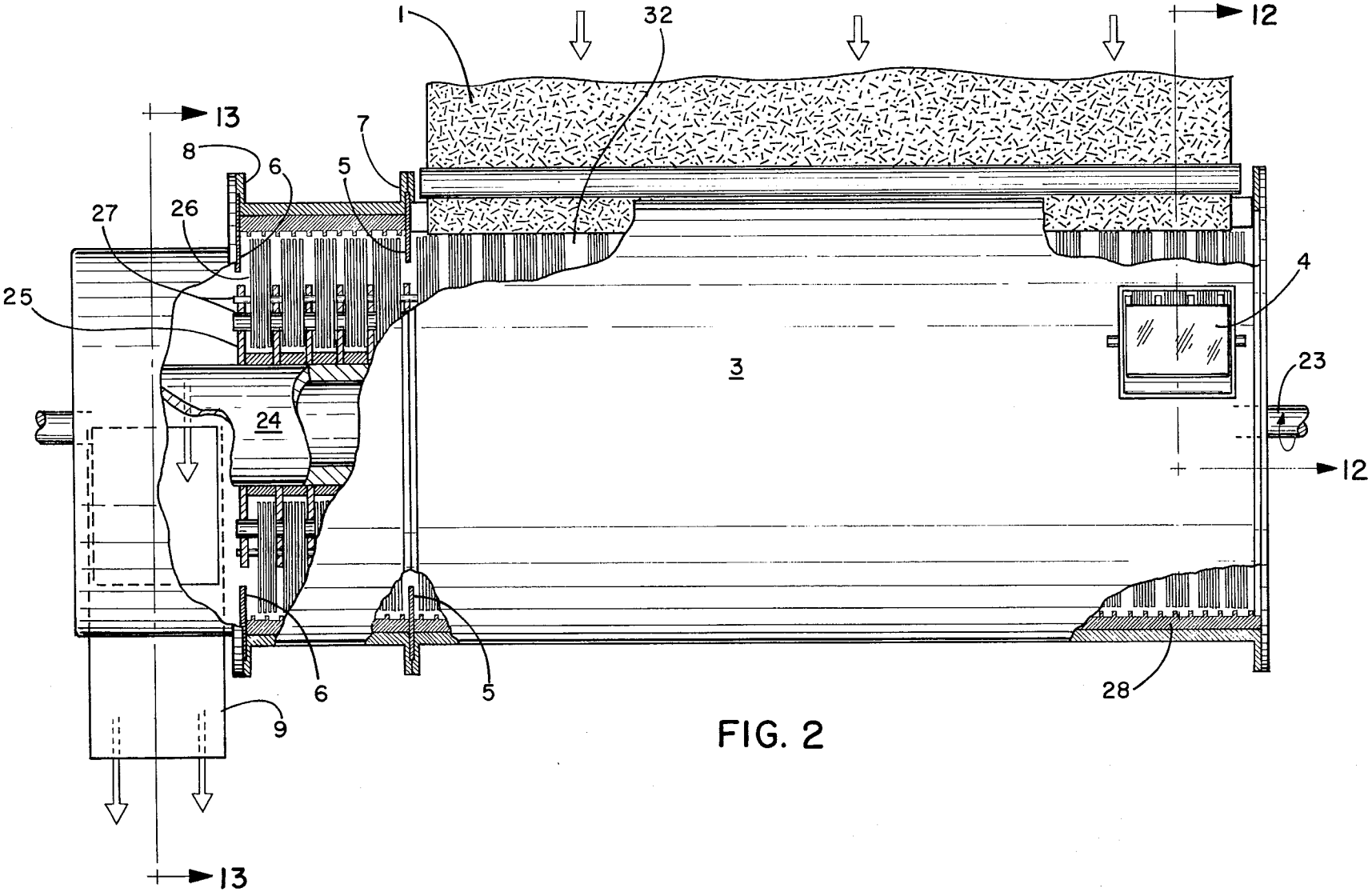
FIG. 2 is a plan view partially in section with parts broken away of one hammermill component of the equipment illustrated in FIG. 1.
Figure 3:
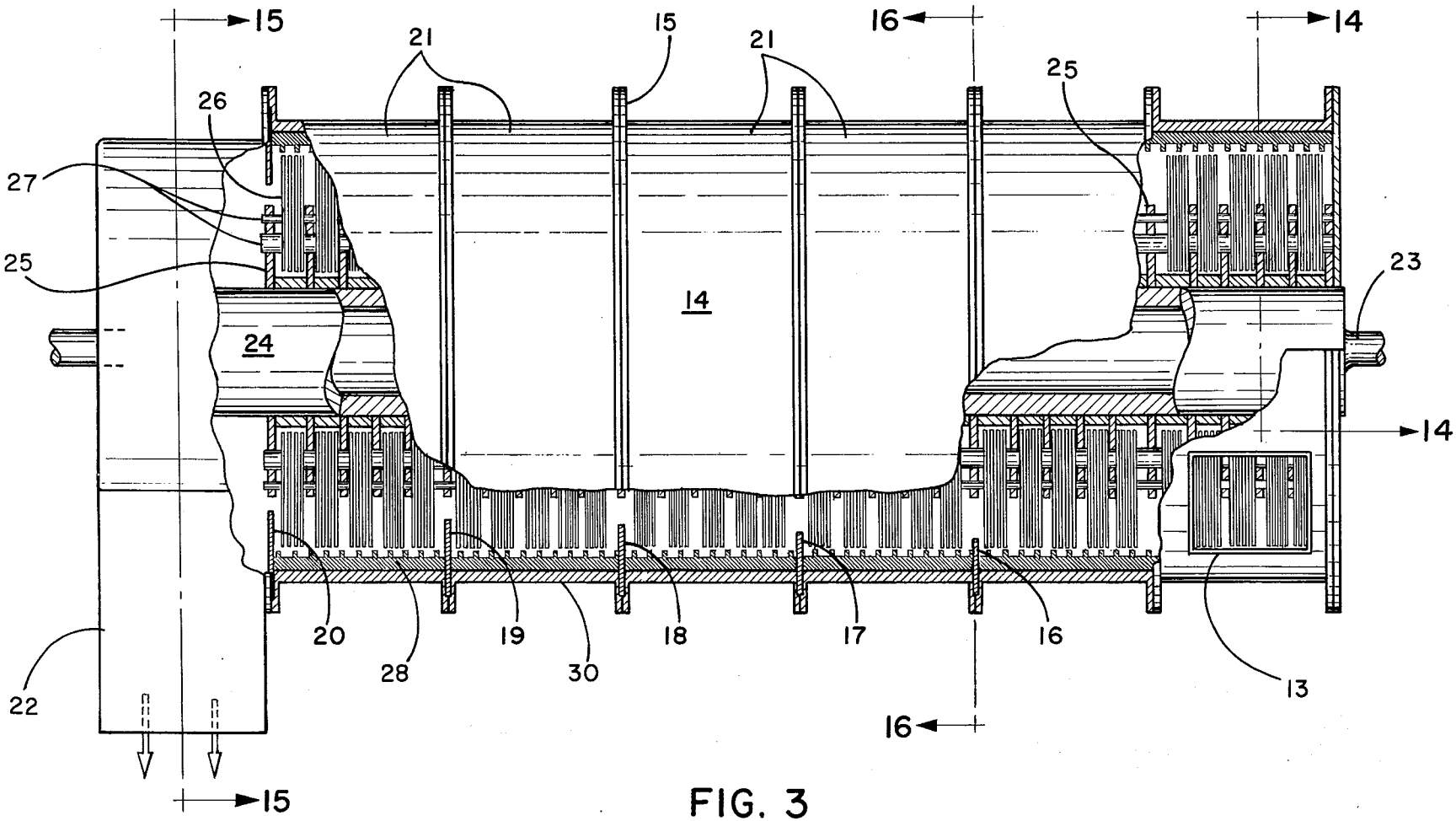
FIG. 3 is a view partially in section with parts broken away of another component of the equipment illustrated in FIG. 1.
Figure 12:
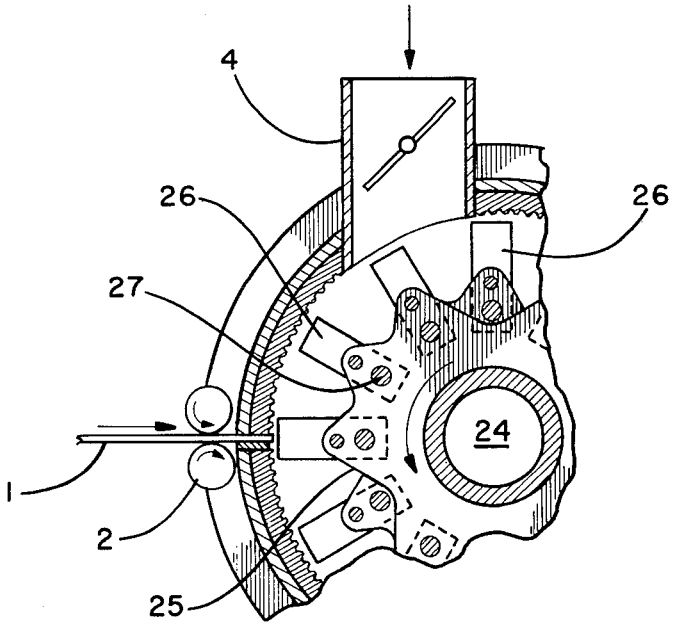
Figure 13:
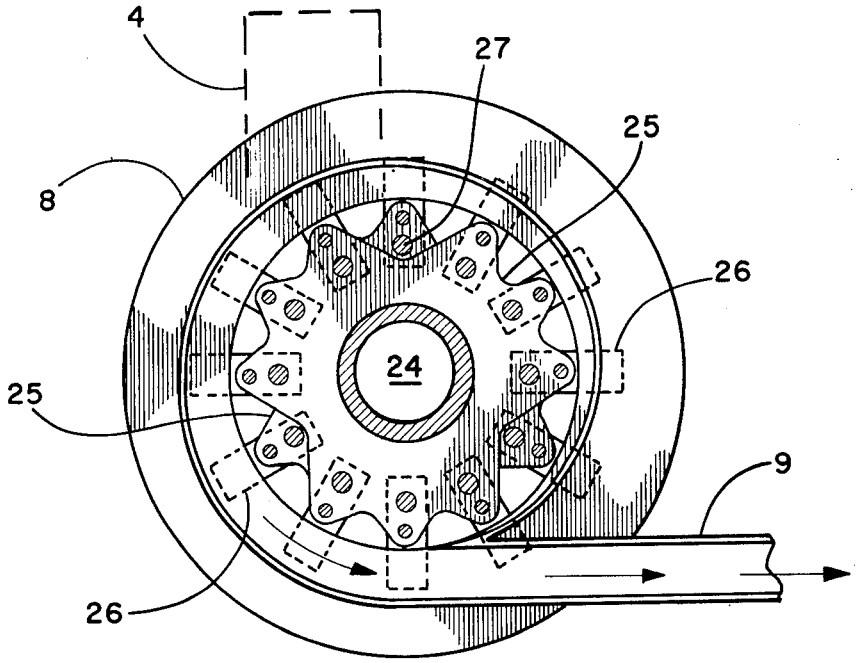
Figure 14:
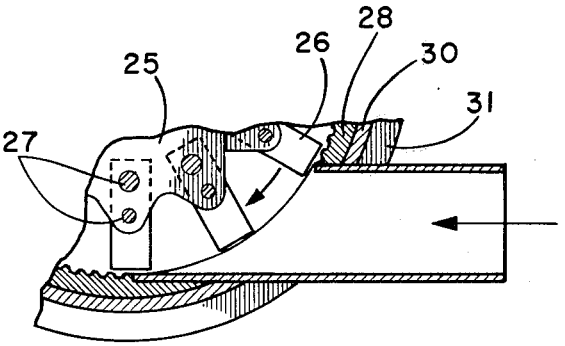
Figure 15:
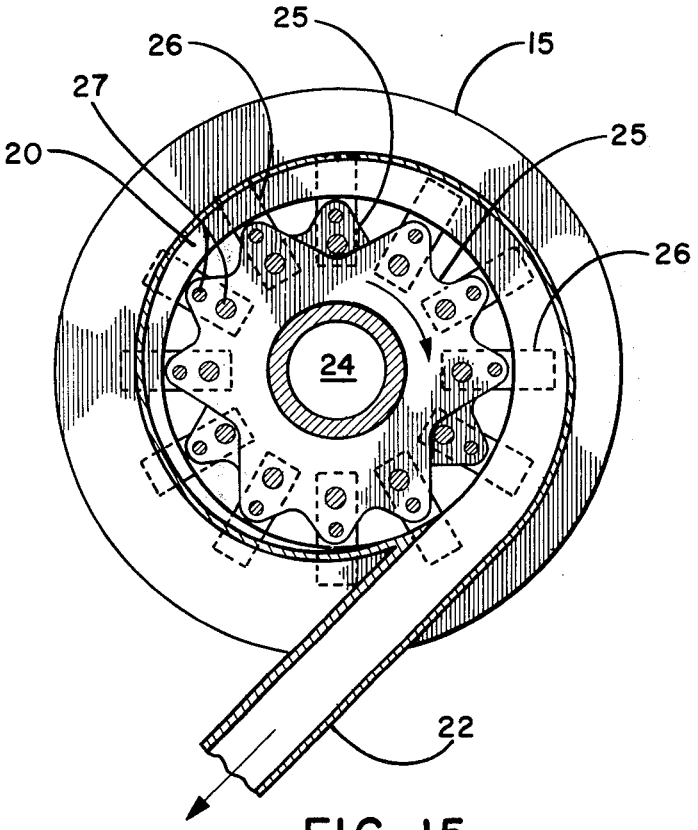
Figure 16:
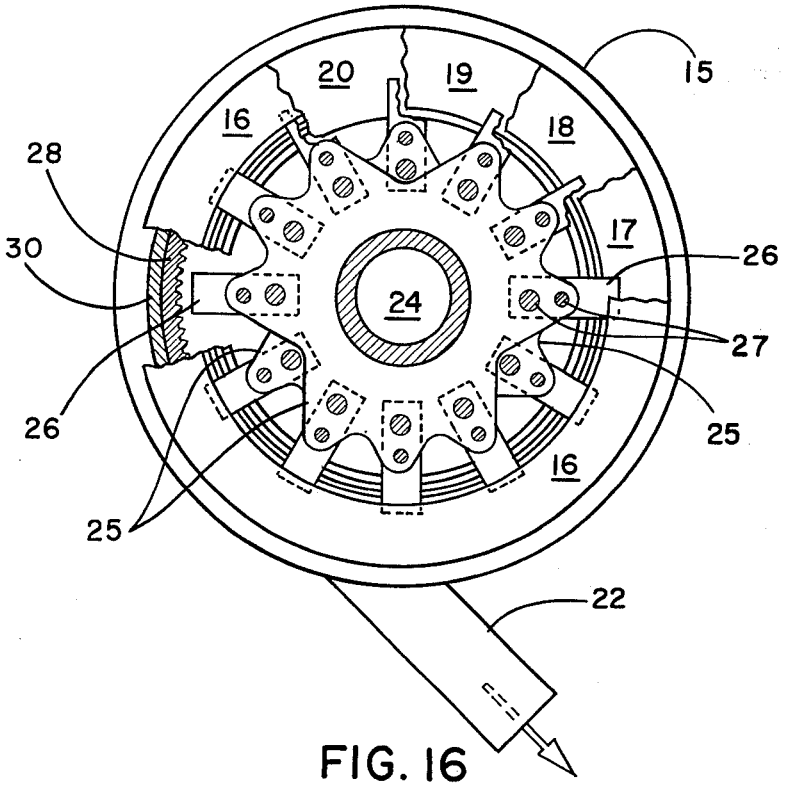
Figure 17:
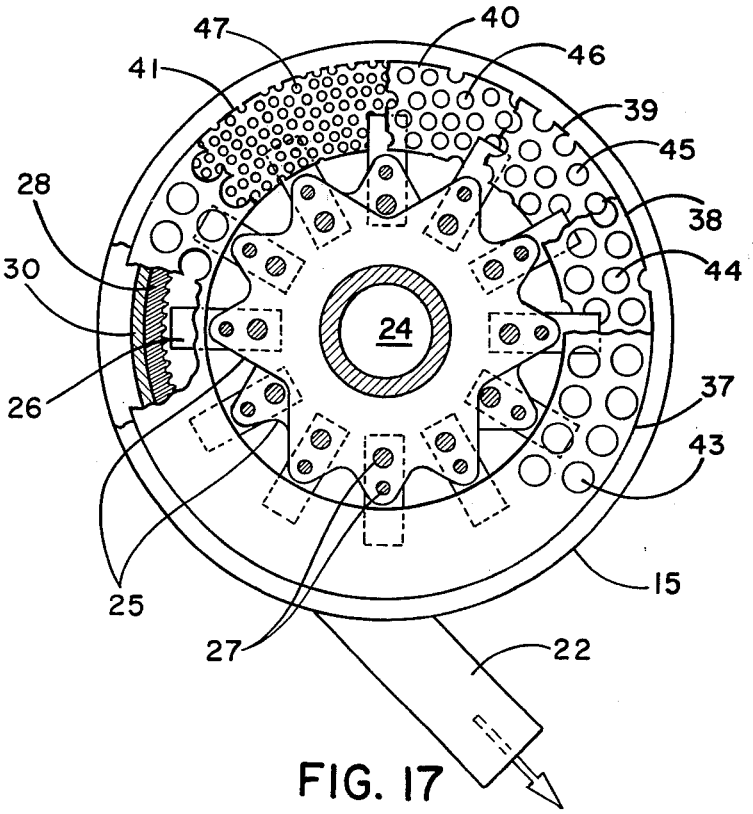
Figure 18:
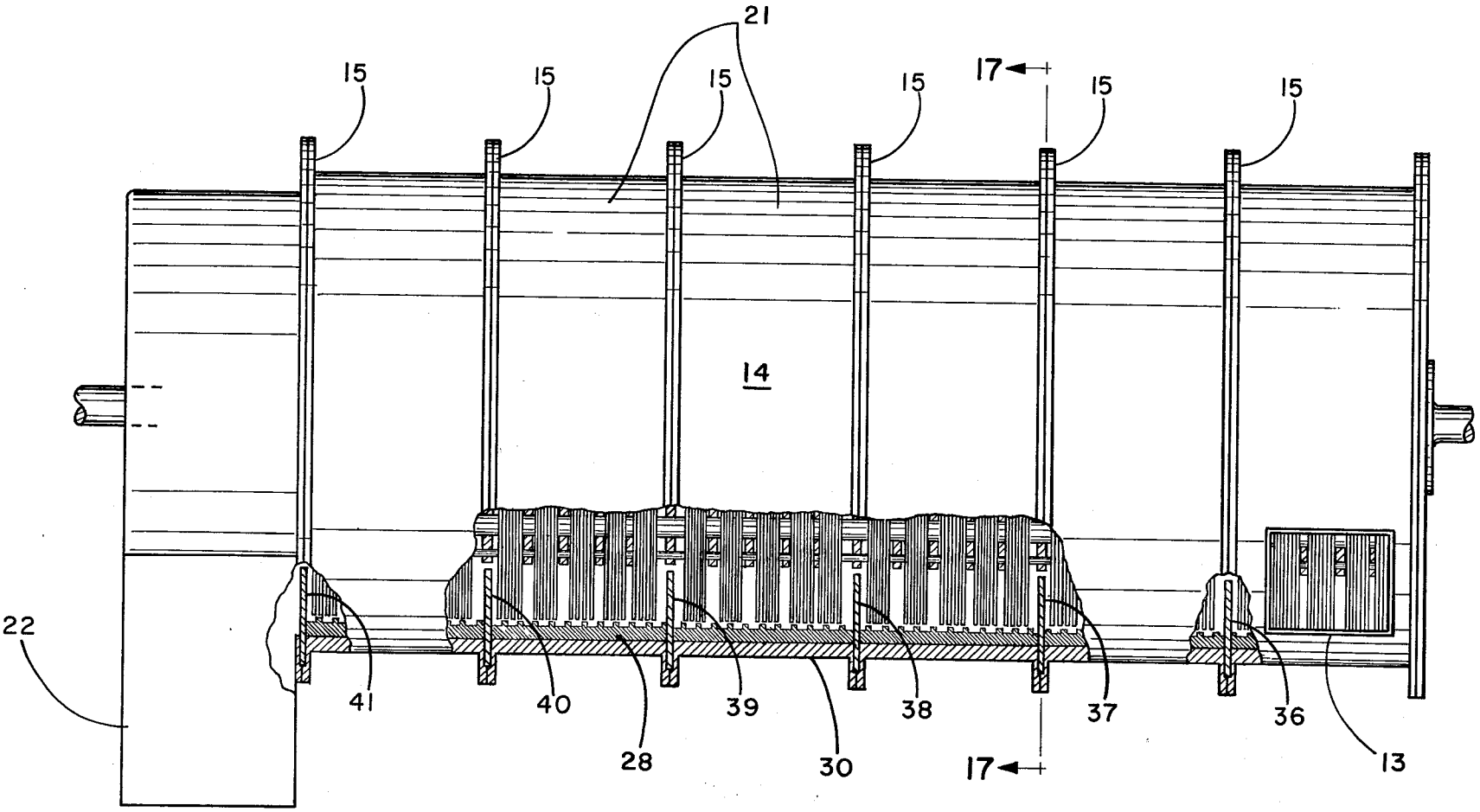

FIGS. 12 and 13 are views taken on lines 12—12 and 13—13 of FIG. 2;

FIGS. 14, 15 and 16 are, respectively, sectional views taken on lines 14—14, 15—15, and 16—16 of FIG. 3;

FIG. 17 is a sectional view taken on line 17—17 of FIG. 18;

FIG. 18 is a view of a hammermill similar to that of FIG. 3 but illustrating a further embodiment of the invention.

Figure 1:
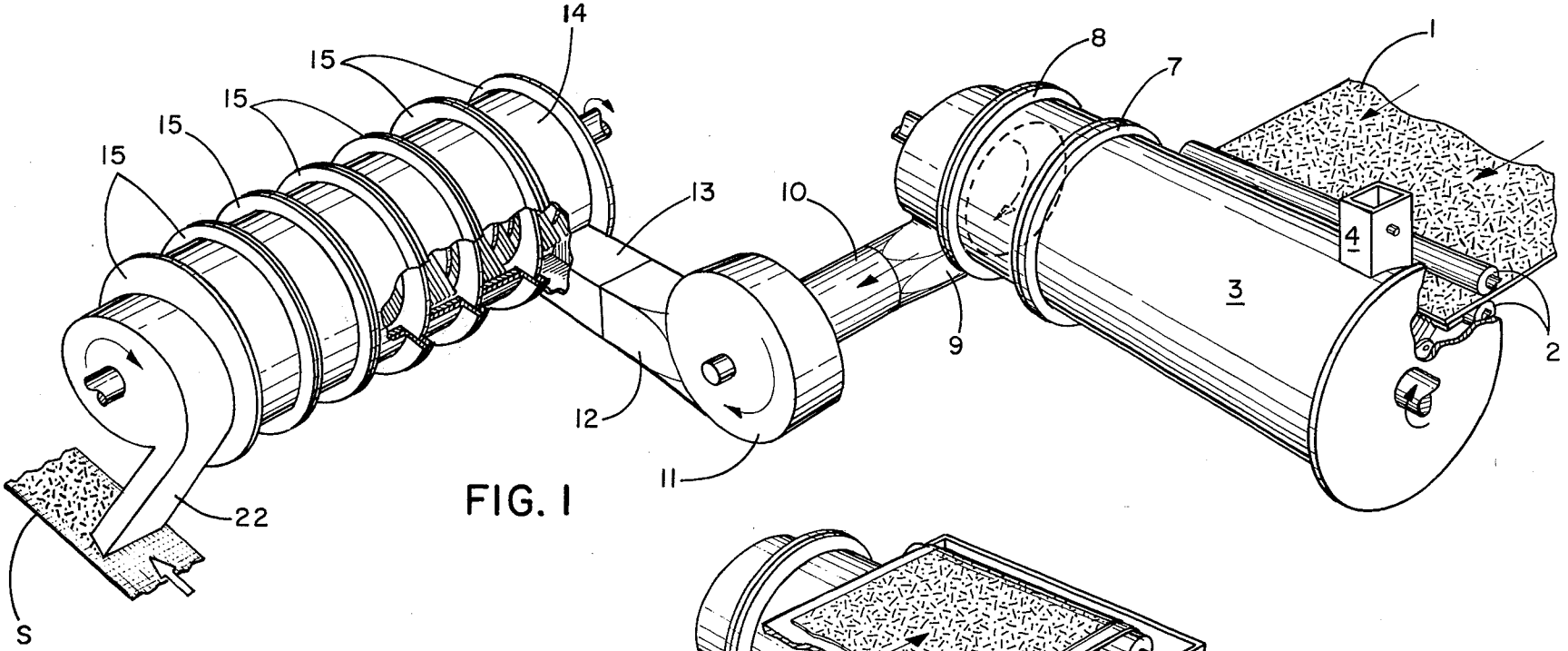
Figure 1A:
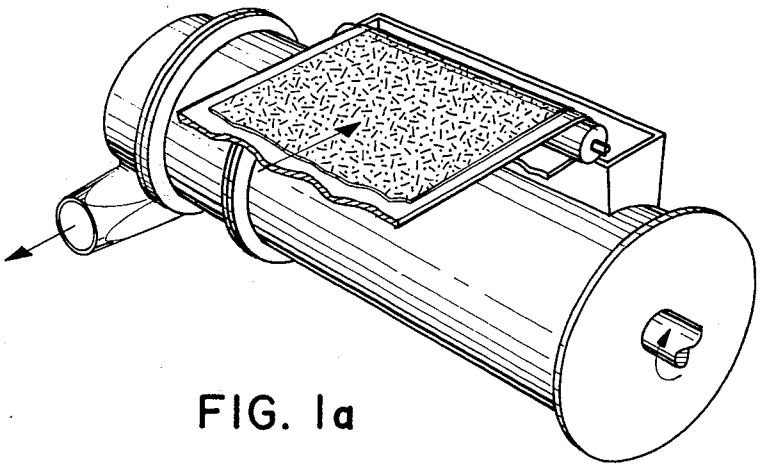

Referring to the drawings more in detail, the numeral 1 in FIG. 1 designates a pulp sheet being fed by oppositely disposed rollers 2 to a hammermill generally indicated by the numeral 3. The hammermill includes an air inlet opening 4. The hammermill 3, as more clearly illustrated in the enlarged view in FIG. 2, is of generally conventional structure except for the inclusion of classifier rings designated at 5 and 6 and retained respectively by flange pairs 7, 8. The ring retaining flanges are positioned closely adjacent the outlet end of the hammermill 3 (FIG. 1). Hammermill 3 also includes an internal wall of grid configuration as described in detail hereinafter.

The outlet 9 of the hammermill 3 communicates through a conduit 10 with a fan 11, the exhaust side 12 of which communicates through inlet conduit 13 with the classifying hammermill 14. Hammermill 14 has a plurality of flange pairs 15, five of which each retain a ring as shown in FIG. 3. The rings of the hammermill 14 are designated at 16, 17, 18, 19 and 20. They decrease in internal diameter from right to left (FIG. 3) and serve as classifier rings. The rings also define compartments 21 of the hammermill of substantially equal axial length. Pulp worked on in the hammermill 3 is fed with the assistance of fan 11 to the classifying hammermill 14. Pulp operated upon in the hammermill 14 is directed through an outlet 22 to any convenient receiving device, storage or source of use of the pulp as indicated as S.

Referring now more particularly to FIG. 2 and the hammermill 3, the mill has a drive shaft 23 which is coupled to a driving motor not shown. The shaft 23 inwardly of the mill is provided with an enlarged axial portion 24 extending over the primary length of the mill. Shaft portion 24 carries a plurality of parallel arranged circular plates 25 (FIGS. 2 and 12). The plates 25 each have a plurality of hammers 26 secured thereto by retainer bolts 27. The hammers 26 (FIGS. 2 and 12) in the operation of the mill rotate with their peripheries moving closely adjacent wall section 28 of the hammermill and so as to abut against and break into fiber pieces the fiber materials fed through feed rolls 2.

Figure 4:
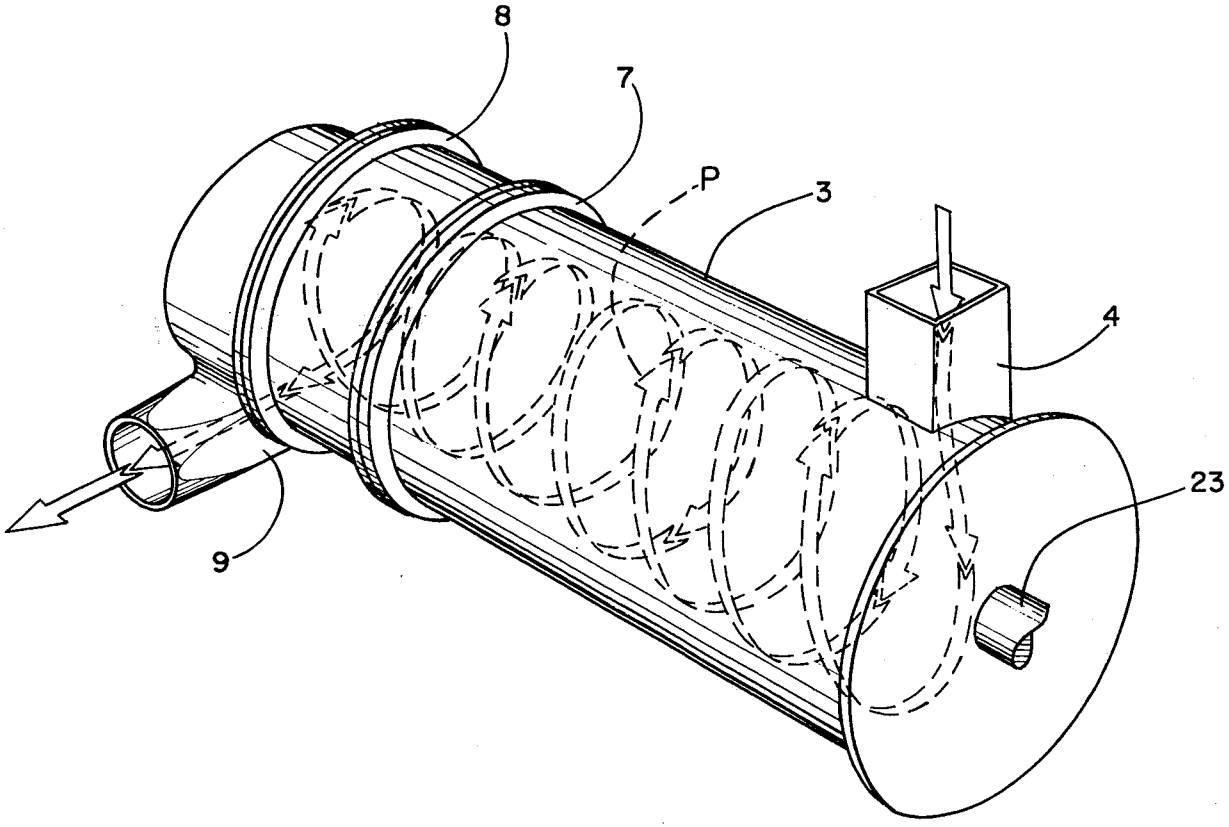
FIG. 4 is a view illustrating the general mode of air flow through the equipment component of FIG. 2.

The internal diameter of ring 5 is somewhat greater than that of ring 6. Air under the influence of fan 11 is drawn through opening 4 and assumes a helical path P (FIG. 4) in which the fibrous material, being broken up under the action of the hammers, tends to move. The internal ring diameter of each ring 5, 6 is less than the diameter of the working zone 32 of the hammermill 3 shown to the right of the classifying rings 5, 6 in FIG. 2. Consequently, in the operation of the device, the pulp will be worked to a reasonably uniform degree in hammermill 3 before exiting from the outlet 9 through the rings 5, 6. These rings tend to retain partially worked fibrous material in the working zone until it becomes sufficiently opened to pass in the air stream to the hammermill 14. Thus, the material which is more difficult to open is retained longer in the working zone while that material which easily reduces to fluff is subjected to less working, thereby saving energy and causing less fiber breakage.

I have found that a very important factor in the working of the fibers to a fluff condition from the sheet 1 is to provide the interior wall of the hammermill as a roughened, or more specifically a discontinuous surface element. The fiberizing action is then materially facilitated for a given power input. The reason for this, while not entirely clear, is apparently that the fibrous material, though it tends to be carried axially by the air stream created by the fan action, is impelled by the hammer rotation toward the wall of the mill. Several factors contribute to this. A first is that the fibrous material is relatively dense and tends by the action of the hammers to be thrown outwardly of the axis. A second is that the air stream itself is distorted by the rapidly rotating hammers and, in effect, a helical air flow (FIG. 4) carrying pulp particles results.

The outwardly thrown fiber particles, containing many hundreds of fibers in the form of a fiber mass M, (FIG. 6) impinge on the discontinuous wall of the hammermill at high velocity. The rough or discontinuous surface provides a number of main effects on the fiber particle action. First, the fibers bound off the wall and the discontinuous nature of the wall may cause bounding in a plurality of directions as indicated by the broken dash line in FIG. 6, as well as slowing the fiber particles in their movement. This increases the relative velocity between the hammers and particles, thereby increasing the impact velocity of the hammers on the fibers. This takes place without a significant fiber cutting if blunt hammers are employed. Further, individual fibers or well fluffed particles, being of low density, will, due to windage effects, move out of the path of the hammers and will not be excessively worked. On the other hand, more slowly moving and more dense fiber masses will be maintained in the working area of the hammers due to centrifugal force, low speed on rebound, and greater free fall velocity since they are less subject to the windage effects. The more dense material will be then acted upon by the hammers to much greater degree, that is, the hitting velocity of the hammers will increase in ft./min. as will the frequency of the hits. An important factor is that the air flow in hammermill 3 should be maintained sufficiently to carry freed fiber material from the zone 32 over the first of the rings, that is, ring 5. Material passing the ring 5 commonly will be well separated into fluff and will pass from hammermill 3 to hammermill 14 under the influence of the air stream.

In the arrangement specifically described (FIG. 1) the hammermill 3 is under a negative pressure as fan 11 draws air through it from opening 4. This negative pressure approach is desirable particularly where long lengths of pulp are fed to the equipment. However, there is then some tendency for pulp fiber agglomeration to occur in the passage through the fan, for example, and the second hammermill is desirable to insure of good fiberizing and a positive feed of fibers to the outlet 22 to the receiving equipment S whether it be a collecting screen for producing a fiber batt, storage or a component of manufacturing apparatus such as a diaper manufacturing machine.

Figure 5:
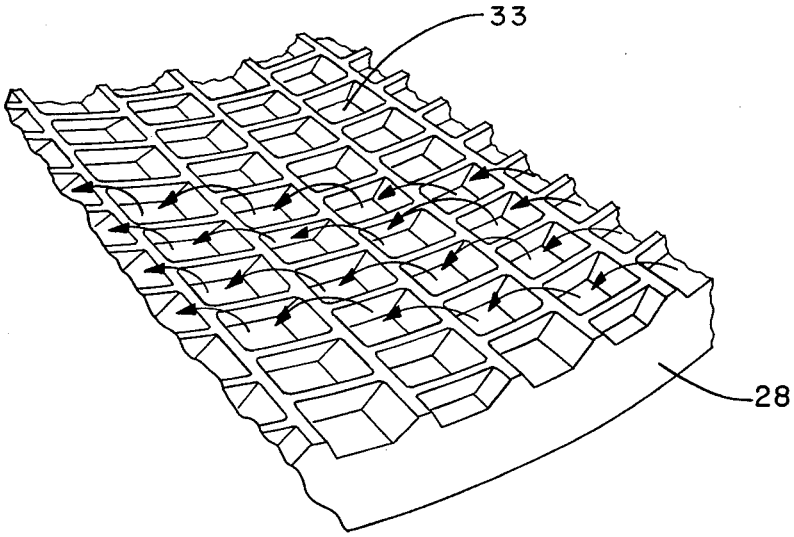
FIG. 5 is a fragmentary view illustrating the arrangement of the wall of the equipment of FIG. 2.
Figure 6:
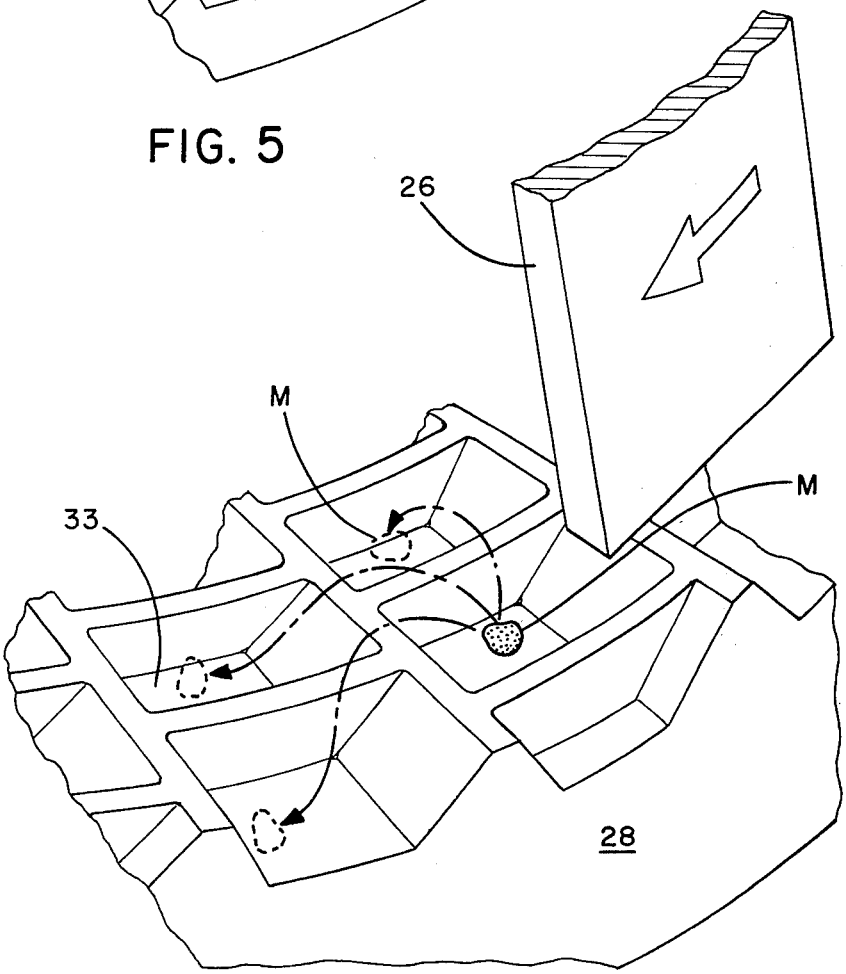
FIG. 6 is an enlarged view of a wall portion of the equipment of FIG. 2 and illustrating its relation to a hammer of the hammermill.
Figure 7:
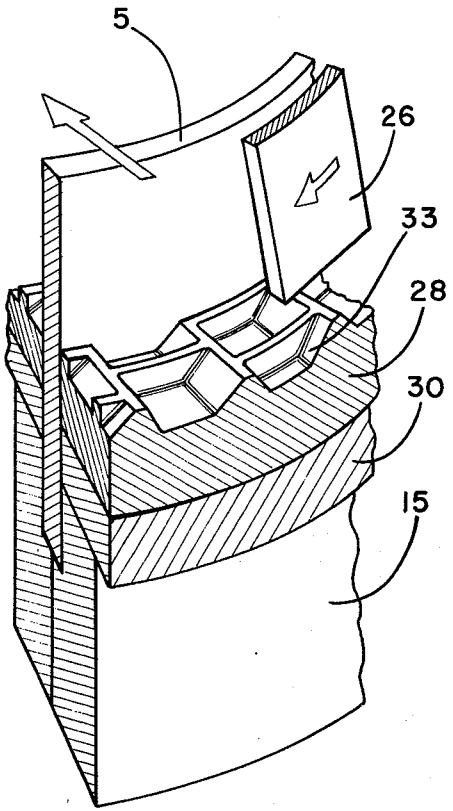

A preferred structural arrangement of the wall of the hammermill is shown in the fragmentary view of FIG. 5. The cooperative arrangement of the hammer and wall is illustrated in FIG. 6 and the arrangement of the hammer closely adjacent the ring axially is shown in FIG. 7.

Figure 9:
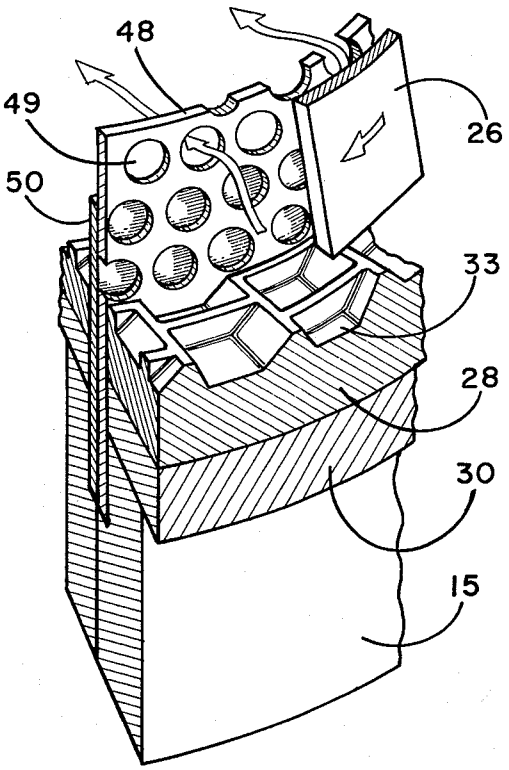
FIGS. 7, 8 and 9 are views similar to that of FIG. 6 but further illustrating the relationship of hammermill wall, hammer and various classifier ring embodiments.
Figure 8:
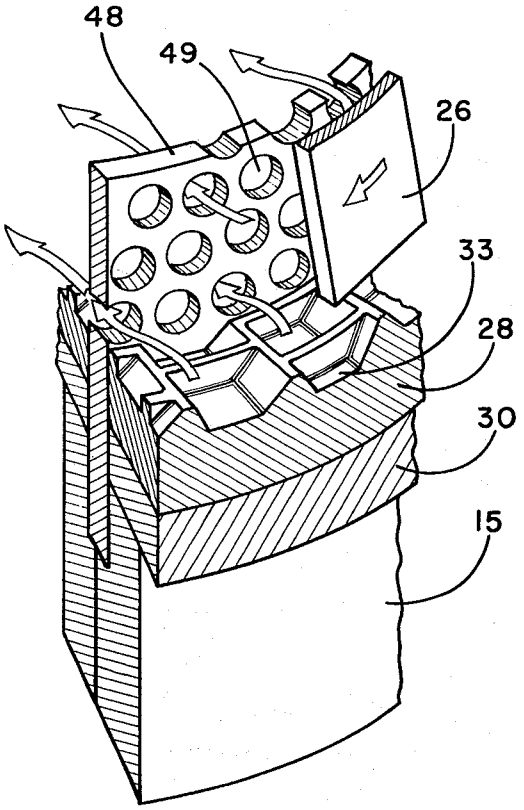

As appears from the drawings, the interior of the wall of the hammermill is made of a plurality of curvilinear sections 28 having, as shown in the FIG. 5 wall configuration, a plurality of integral pockets 33. Each section 28 is retained on a liner 30 of the primary cylindrical wall 31 (FIG. 9). In the enlarged view, FIG. 6, the approach of a hammer 26 to fibrous material particles M as the particles bound from pocket to pocket is illustrated and makes clear how the provision of the interrupted wall surface promotes contact of the hammer and particles at good relative speed. Additionally, the hammer itself is chosen to be relatively narrow, that is, between about 0.062 inch (0.16 cm.) and 0.250 inch (0.635 cm.). Too wide a hammer leads to impacting fibrous material directly onto the wall while too narrow a hammer leads to fiber cutting. The reception and release by the pockets of the fibrous material, as well as the differential in the fiber and hammer speeds, contribute materially to fiberizing without cutting.

Figure 10:
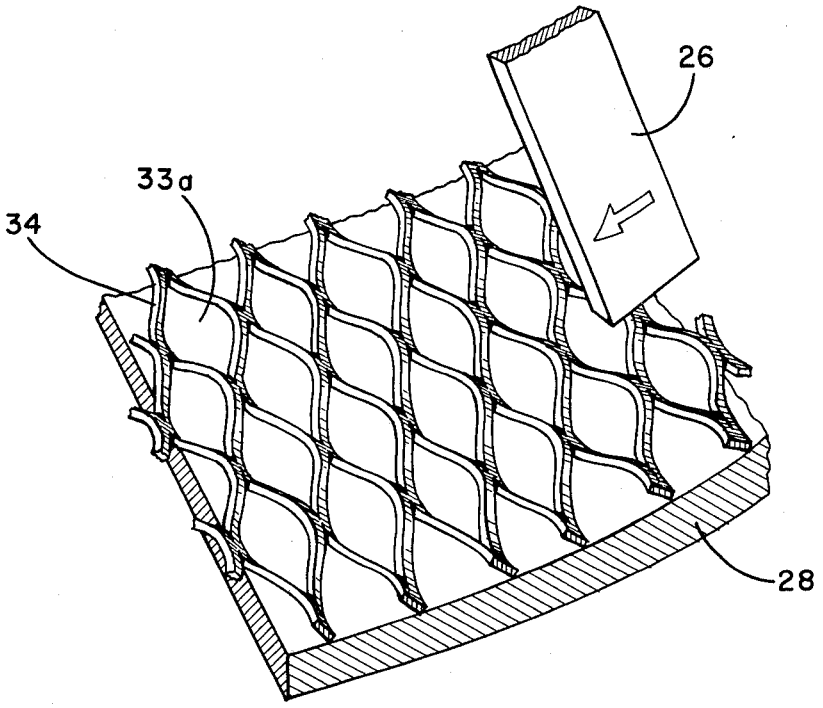
FIGS. 10 and 11 are views similar to that of FIG. 5 and illustrating embodiments of other useful wall configurations.
Figure 11:
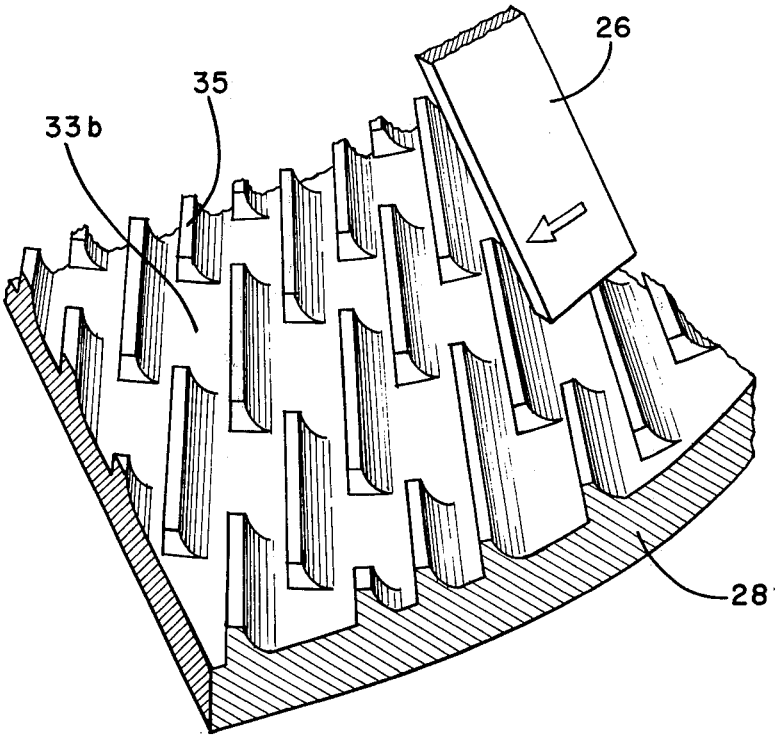

The pockets may be formed by expanded metal 34 secured to the wall section 28 as illustrated in FIG. 10 at 33*a* or may be formed by a series of upstanding ribs 35 as indicated at 33*b* in FIG. 11.

The hammers are preferably fixedly arranged on the drive shaft in close proximity to each other and most suitably the arrangement of the hammers close to a classifier ring on the upstream side are more closely positioned together than are the hammers remote from a ring. Thus, for a length of 3 to 4 inches on the upstream side of ring 26 the hammers preferably are very closely associated. Also for maximum fiberization action, the closest hammer to a solid classifier ring on the upstream side should be at least about 1/16 inch up to about, but preferably well below, 1 inch. If a hammer is too closely positioned to a ring, fibrous material may tend to become trapped between the stationary ring and rapidly moving hammer, thus tending to inefficient operation and fiber buildup.

The hammer speed, as in any effective hammermill operation, must be relatively high. Hammer tip speeds of 10,500 to 18,000 feet per minute are typical. The speed of operation for a particular system is chosen in view of the system parameters and the nature of the wood pulp itself, some wood pulps being more conducive to high speed than are other pulps. Such high speed contributes materially to a hitting frequency by the hammers on pulp undergoing defiberizing of 11,000 to 13,000 hits per second per inch of active mill length. The length of a cell should be at least 4 inches and as illustrated by the showing of hammermill 14, a plurality of cells are usefully employed.

The usual minimum of air to fiber ratio for suitable fiberizing action in the passage of a hammermill appears to be about 100 to 150 cubic feet of air per pound of fiber at normal temperatures and pressure. Air to fiber ratios of about 300 to 400 cubic feet of air per pound of fiber have been successfully employed. Also, the inlet and outlet are provided to facilitate helix flow of the air, the angle of the helix varying somewhat with the flow rate of the air.

The internal diameter of the classifier rings suitably decreases in the direction of air flow (FIG. 3). This provides that the air flow velocities through the classifier rings will increase in the direction of the fiber flow providing thereby that the work expended on the fibrous material will also increase in the direction of the fiber flow. This latter increase, however, will occur primarily on the larger undefiberized particles and only to an insignificant degree on fibers which are early reduced to a fluffy fibrous state and easily conveyed by the air stream.

The solid classifier rings 5, 6 serve well to classify and to pass fibers which have been brought to a fluff condition or individual fiber condition. I have found, however, that some tendency exists with solid classifier rings to trap fibers and cause fiber agglomeration. Surprisingly, the use of a perforated annulus has been found to be very effective as a classifier ring. Not only does the character of the fiberizing improve but the horsepower required per ton of fiberized material per hour of operation is reduced for the degree of fiberizing achieved. Importantly, I have found that it is most beneficial to provide in the hammermill a plurality of the longitudinally spaced classifier rings and to have such rings perforated, and further, to have the apertures or holes in the annulus decrease in diameter in the direction of fiber flow. By this arrangement the amount of work expended in defiberizing may be equalized for each cell or compartment, an approach which leads to efficient use of applied power.

In the arrangement of FIG. 3 the classifier rings are solid in the annulus area and decrease in internal diameter in the direction of fiber flow, an arrangement which provides for increasing air velocity in the direction of fiber flow. A similar result is attained in the structure of FIG. 18 in a somewhat different manner. The flanged pairs 15 of FIG. 18 each retain a classifier ring and such are numbered 36 through 41, the rings 36 through 40 being indicated in section in FIG. 18. In this instance each classifier ring is apertured and the apertures are of circular shape and decrease in diameter in the direction of fiber flow (FIG. 17). As illustrated in FIG. 17, the apertures of ring 37 are indicated at 43, those of ring 38 at 44, those of ring 39 at 45, those of ring 40 at 46 and those of ring 41 at 47.

In a further modification (FIG. 9) the structural arrangement includes adjacent an apertured classifier rings having circular apertures 49 and a solid ring 50 which projects from the wall and partially shuts off the apertures of the classifier ring to air flow. This leads to greater selectivity in fiber passage from one cell to the next cell in the fiberizing operation.

As a general rule employing apertured classifier rings, it is beneficial to maintain a diameter of at least one-quarter of an inch as the smallest opening employed. Further, the open area of each classifier ring may suitably be as great as the strength of the ring will permit and the open areas of all rings of a particular mill may be equal. Further, the hammers should be close together in the zone adjacent the upstream side of an apertured classifier plate and the hammer should be as close as possible to the plate, that is, 1/16 to one-eighth inch for optimum operation.

EXAMPLE 1

In specific application two hammermills in sequence, both 32 inches in diameter and having an inside surface lining as illustrated in FIG. 5, were employed in the defiberizing of northern softwood kraft containing a debonding agent. The overall length of each hammermill was 6½ feet. No classifier rings were used. The hammer width (or thickness) was 3/32 inch and the hammers operated at tip speeds of 14,000 fpm. The total number of hammers in each mill was 600. An air to fiber ratio of 305 cubic feet per pound of fibers was employed at a pulp feed of 305 pounds per hour in a shredded form. Complete fiberization was achieved without significant damage to fiber length.

EXAMPLE 2

Two hammermills, both 16 inches in diameter, were employed and the inside surfaces were lined with expanded metal as in FIG. 10. The overall length of each mill was 15 inches and the first hammermill has one classifier ring at the outlet; the second hammermill had two classifier rings, one half-way between the mill ends and the other one at the outlet.

All three classifier rings had the same inside diameter, that is, 14 inches. The hammer width (or thickness) was 1/16 inch and the hammers operated at a tip speed of 12,000 fpm. The total number of hammers in each mill was 123, at an air to fiber ratio of 400 cubic feet per pound of fiber. A commercially available debonded southern softwood kraft was completely fiberized at a rate of pulp feed of 200 pounds per hour. The feed was from rolls of pulp. No significant damage to fiber length occurred.

In each specific instance as measured by standard test procedures, no significant fiber damage, for example, fiber shortening, occurred. In contrast, conventional hammermills investigated caused substantial fiber damage when fiberization of fiber bundles was complete.

As many apparently widely different embodiments of this invention may be made without departing from the spirit and scope thereof, it is to be understood that I do not limit myself to the specific embodiments thereof except as defined in the appended claims.

I claim:

1. A process for separating a body of fibrous material into substantially individual fibers which comprises passing the fibrous material in a generally helical path in a current of air while impacting with impact elements the fibrous material to break it into fibers and at the same time slowing the movement of the fibrous material relative to the impact elements by causing the material to move along and against a grid-like impervious wall surrounding the current of air so that the slowed movement of the fibrous material permits it to be subjected to repeated impacts by the impact elements, said current of air carrying defiberized fibrous material through apertured classifier rings while the said rings retain for further defiberizing action material which is insufficiently defiberized, the defiberized material passing through the apertures of the rings.

2. Apparatus for the processing of fibrous material to separate the material into fibers comprising an elongated housing having an inlet for fibrous material and an outlet for processed fibrous material adjacent to the end opposite said inlet and through which outlet fibers pass, a shaft in said housing and extending lengthwise thereof, air propelling means for causing the fibrous material to move in an air stream from the said inlet to the said outlet, impact elements carried by said shaft operable in said air stream for breaking up fibrous material in the air stream and liberating fibers while causing the fibrous material in the air stream to move in a helical path, wall means of said housing substantially concentric with said shaft and impact elements and imprevious to the passage of fibers so that fibrous material passing through said inlet may move lengthwise of the housing while being impacted by said impact elements and broken up into fibers, said wall means having a grid-like interior surface confronting said impact elements so that fibrous material contacting the wall is slowed in its movement relative to said impact elements and thereby subjected to repetitive impact of the impact elements, the said elongated housing having interior rings extending transversely of the housing in spaced relation dividing the housing longitudinally into compartments, and at least one of the rings having an annulus which is perforated.

3. Apparatus as claimed in claim 2 and in which there are a plurality of rings and the apertures of the annuli of the rings decrease in diameter as the rings lie towards the outlet of the housing.

4. Apparatus as claimed in claim 2 and in which the rings decrease in internal diameter as the rings lie closer to the apparatus outlet and at least one of the rings is perforated and backed by a solid ring.

* * * * *

UNITED STATES PATENT OFFICE

CERTIFICATE OF CORRECTION

PATENT NO. : 3,966,126

DATED : June 29, 1976

INVENTOR(S) : Edward E. Werner

It is certified that error appears in the above-identified patent and that said Letters Patent are hereby corrected as shown below:

Column 2, line 49, "not" left out before "critical", and "ciritical" inserted after "critical" should be removed. Please insert the word "not" before "critical" in line 49 of column 2.

Signed and Sealed this

Nineteenth Day of October 1976

[SEAL]

*Attest:*

RUTH C. MASON
*Attesting Officer*

C. MARSHALL DANN
*Commissioner of Patents and Trademarks*